US007691321B2

(12) United States Patent
Downie

(10) Patent No.: US 7,691,321 B2
(45) Date of Patent: Apr. 6, 2010

(54) THERMIC LANCE

(75) Inventor: Neil Downie, Guildford (GB)

(73) Assignee: Air Products and Chemicals, Inc., Allentown, PA (US)

( * ) Notice: Subject to any disclaimer, the term of this patent is extended or adjusted under 35 U.S.C. 154(b) by 356 days.

(21) Appl. No.: 11/732,973

(22) Filed: Apr. 5, 2007

(65) Prior Publication Data

US 2007/0290417 A1 Dec. 20, 2007

(51) Int. Cl.
*B23K 7/00* (2006.01)

(52) U.S. Cl. ..... 266/48

(58) Field of Classification Search ..... 266/48
See application file for complete search history.

(56) References Cited

U.S. PATENT DOCUMENTS

| | | | | |
|---|---|---|---|---|
| 340,747 | A | 4/1886 | Weibach | |
| 1,761,094 | A | 6/1930 | Shunk, Jr. | |
| 3,090,856 | A | 5/1963 | Rorvig | |
| 3,570,419 | A | 3/1971 | Brandenberger et a | |
| 3,588,303 | A | 6/1971 | Karrer | |
| 3,738,288 | A | 6/1973 | Brandenberger et al. | |
| 4,055,332 | A | 10/1977 | Sweeney et al. | |
| 4,391,209 | A | 7/1983 | Moore et al. | |
| 4,423,855 | A | 1/1984 | Kallenbach | |
| 4,915,618 | A | 4/1990 | Brandin | |
| 4,985,610 | A | 1/1991 | Rucker et al. | |
| 5,580,515 | A | 12/1996 | Petrovich | |
| 5,622,672 | A | 4/1997 | Swick et al. | |
| 5,710,390 | A * | 1/1998 | Ofca | 102/275.4 |
| 5,993,201 | A | 11/1999 | Green et al. | |
| 2002/0152912 | A1 | 10/2002 | Hiskey et al. | |

FOREIGN PATENT DOCUMENTS

| | | | |
|---|---|---|---|
| EP | 0 007 289 | A | 1/1980 |
| FR | 1502040 | A | 11/1967 |
| GB | 1 093 336 | A | 11/1967 |
| GB | 1343023 | A | 1/1974 |
| GB | 2151530 | A | 7/1985 |

* cited by examiner

*Primary Examiner*—Scott Kastler
(74) *Attorney, Agent, or Firm*—Willard Jones; Eric J. Schaal

(57) ABSTRACT

The present invention relates to use of a thermic lance as a firework. Frictional or electrical ignition of a thermic lance is more convenient and safer than conventional methods. In addition, when used as a firework, the lance is safer and provides less pollution than conventional fireworks.

18 Claims, 4 Drawing Sheets

THERMIC LANCE

TECHNICAL FIELD OF THE INVENTION

The present invention relates to thermic lances and the use thereof, particularly as fireworks.

BACKGROUND OF THE INVENTION

Thermic lances were developed following the Second World War as a means by which gun emplacements, submarine pens and other large concrete structures could be broken up or demolished quickly and conveniently.

Operation of a thermic lance usually involves feeding gaseous molecular oxygen through a length of steel tube, the tip of which has previously been heated to combustion temperature. The oxygen combines with the iron in the steel of the lance to form a slag that is rich in iron oxides. The slag produced is very hot and very fluid thus enabling the lance to be used as a cutting and/or boring tool. The flow of slag is assisted by the velocity of the gas and the vapours expelled within it.

The lance is usually packed with steel rods such that the ratio of iron to oxygen is increased thus providing sufficient heat to melt concrete (the melting point of which is between 1800 to 2500° C.) and/or ferrous or non ferrous metals. The heat output of a lance may be increased by adding aluminum and/or magnesium to the packing. Smaller lances have been packed with a roll of sheet steel in place of steel rods.

Examples of thermic lances are disclosed in, for example, U.S. Pat. No. 3,570,419 (Brandenberger; published 1971), U.S. Pat. No. 3,738,288 (Brandenberger; published 1973) and GB-A-2151530 (Partington; published 1985)

A thermic lance is usually ignited by heating the tip of the lance to the combustion temperature using an oxy-acetylene torch. The tip may also be heated to the required temperature by shorting the tip over a car battery. Either way, once heated, oxygen is then fed through the lance promoting fusion at the lance tip. The combustion reaction is self-supporting and will continue until either the flow of oxygen is stopped or all of the fuel from steel has been consumed. The lance itself is obviously consumed during operation.

The use of an oxy-acetylene torch or a car battery to ignite the lance is not necessarily convenient in all circumstances. In addition, the use of fuel gases with an oxy-acetylene torch is potentially dangerous. The Lance Igniter Tube (or "LIT") process (Australian Thermic Lance Company) has been developed as a safer way to ignite thermic lances. The process involves the use of a Lance Wick and a Lance Igniter Tube. Once lit, the Lance Wick smoulders slowly. The lance is placed over the LIT tube and the smouldering wick is placed in the same position. Oxygen gas is fed through the lance at low pressure and the wick flares into flame and ignites the LIT tube. The lance is moved into the LIT tube and the oxygen gas flow increased to cause a fierce flame which heats up the end of the lance to the point of ignition.

Ignition of a thermic lance using the LIT process requires two people and, thus, is not convenient if a second person is not available.

U.S. Pat. No. 4,055,332 (Sweeney; published 1977) discloses a thermic lance having a plastic igniter unit for igniting the tip of the lance. The plastic igniter unit is ignited using an electrically ignitable ignition element such as an electric match or an electric squib. The lance is ignited by igniting the igniter unit in a flow of oxygen through the lance.

U.S. Pat. No. 5,622,672 (Swick et al; published 1997) discloses a thermic lance having a chemical igniter unit for igniting the tip of the lance. The unit is sealed and contains a pyrophoric material which spontaneously ignites in a flow of oxygen. The unit is pierced by the lance when struck against a hard surface and the lance is ignited by then passing oxygen through the lance.

U.S. Pat. No. 4,915,618 (Brandin; published 1990) discloses a thermic lance having a chemical igniter unit which is actuated under the pressure of oxygen. The igniter unit includes a primer composition (e.g. iron thermite) and a friction sensitive primary explosive which is used as a primer. A frictional element such as a wire spring is embedded within the primer. A flow of oxygen through the lance causes the frictional element to be blown out of the primer thereby igniting the primer which in turn ignites the primer composition and then the lance.

The lances of U.S. Pat. No. 5,622,672 and U.S. Pat. No. 4,915,618 have particular application for underwater use.

Objectives of preferred embodiments of the present invention therefore include:

providing a thermic lance that may be ignited more safely, more simply and more conveniently by one person; and providing a thermic lance that may be ignited from a safe distance, e.g. remotely.

Conventional fireworks involve the use of dangerous, explosive and toxic materials. For example, the primary explosive in a firework is usually black powder which is a well known mixture of charcoal, sulfur and potassium nitrate in particular proportions. The products from exploding black powder include smoke, pollutant gases such as sulfur dioxide and sodium and potassium ions which can destroy or sicken non-salt tolerant plants. In addition, the colouration in a firework is usually provided by metal chlorates and/or perchlorates which are usually highly toxic.

A further objective of preferred embodiments of the present invention therefore include providing a safer and more convenient alternative to conventional fireworks.

SUMMARY OF THE INVENTION

According to a first aspect of the present invention, there is provided use of a thermic lance as a firework.

According to a second aspect of the present invention, there is provided a system of fireworks, said system comprising:

a source of pressurised oxidant gas;

a plurality of thermic lances;

an oxidant gas flow control valve for each thermic lance;

a first conduit for each pairing of a valve and a thermic lance, each first conduit for providing gas flow communication between said valve and the oxidant gas inlet end portion of the outer tube of said thermic lance; and a second conduit for providing gas flow communication between said source of pressurised oxidant gas and each valve.

According to a third aspect of the present invention, there is provided a method of using at least one thermic lance as a firework, said method comprising:

passing pressurised oxidant gas at an "ignition" flow rate through said thermal lance from the oxidant gas inlet end portion of the outer tube to the outlet end thereof;

igniting said lance;

after ignition, maintaining the flow of pressurised oxidant gas through said lance at a "standby" flow rate until said firework is required; and then when required, increasing the flow of pressurised oxidant gas from said "standby" flow rate to a "display" flow rate.

According to a fourth aspect of the present invention, there is provided a thermic lance comprising:

a combustible metal outer tube having an oxidant gas inlet end portion and an outlet end portion, said end portions being in gas flow communication along at least one gas flow path; and a friction ignition system mounted at the outlet end portion of the outer tube, said friction ignition system comprising a rotor and a combustible housing, said housing comprising a gas inlet mounted in gas flow communication with the or at least one gas flow path, and a gas outlet, said housing defining a gas flow pathway between the gas inlet and the gas outlet(s), said rotor being mounted within said gas flow pathway for rotation within the housing by a flow of gas along said gas flow pathway.

According to a fifth aspect of the present invention, there is provided a thermic lance comprising:

a combustible metal outer tube having an oxidant gas inlet end portion and an outlet end portion, said end portions being in gas flow communication along at least one gas flow path;

a combustible plastic fuse mounted at the outlet end portion of said outer tube for igniting said lance; and an electrical ignition system for igniting said fuse, wherein the plastic fuse further comprises a plurality of combustible metal wires extending from the fuse into said outer tube.

DETAILED DESCRIPTION OF THE INVENTION

Figure 1:
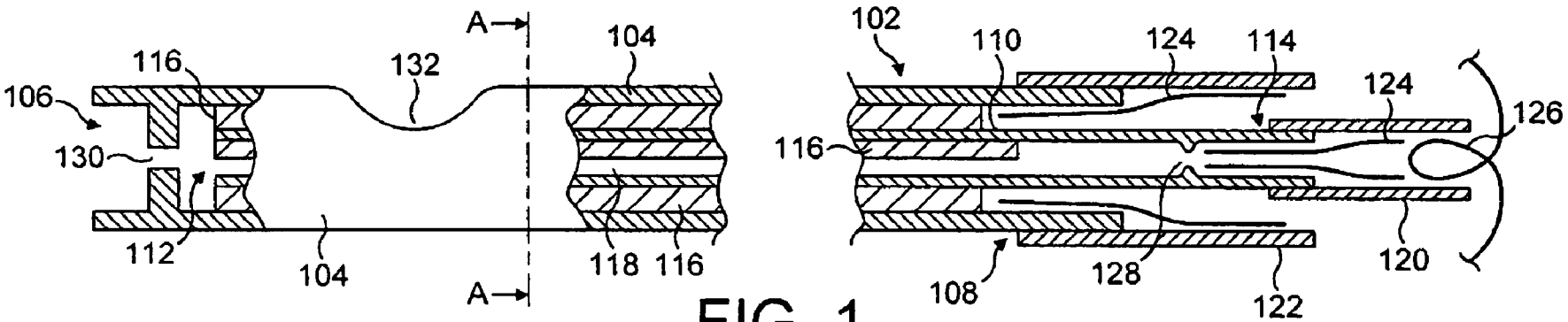
FIG. 1 is a partial cross sectional representation of a side view of a thermic lance having an electrical ignition system.

The Inventor realised that the shower of "sparks" produced by a thermic lance in use is aesthetically pleasing and, thus, believes a thermic lance, preferably suitably modified, provides a suitable substitute for certain forms of conventional firework including "fountain" and "gerb" fireworks. The Inventor also realised that the current modes of ignition of conventional thermic lances could be improved so they are suitable for use with a thermic lance firework. Current ignition modes often involve sources of a fuel gas and, thus, are potentially dangerous.

The Inventor has observed that plastics materials and, in particular, polyurethane and polystyrene, may be used to ignite the tip of a thermic lance. A plastic fuse may be ignited using low power electrical means and the ignited fuse itself ignites a thermic lance. The Inventor has discovered that, surprisingly, the plastics material may also be ignited by friction. In this way, controllable and reliable ignition of a thermic lance may be achieved conveniently by one person from a remote location. The Inventor has also discovered that remote ignition is sufficiently reliable for a thermic lance to be used as a firework.

The Inventor does not consider the design of the lance itself to be critical to its application as a firework. A typical thermic lance comprises a combustible metal outer tube having an oxidant gas inlet end portion and an outlet end portion and the end portions are in gas flow communication along at least one gas flow path. Lances having such a construction are suitable for use with the present invention. Preferably, however, an ignition system or unit is mounted at the outlet end portion of the outer tube. Preferred ignition systems allow the lances to be ignited reliably, controllably and remotely, e.g. a safe distance from the lance outside the range of the sparks.

The Inventor envisages embodiments in which the ignition system is mounted directly on the outer end portion of the outer tube of the lance. However, such an arrangement is not essential. It is sufficient that the ignition system is mounted at or near the outer end portion. The term "near" means a distance suitable for the igniter unit to ignite the lance.

In one embodiment, the thermic lance has an electrical ignition unit comprising:

a combustible plastic fuse; and an electrical ignition system for igniting said fuse. The electric ignition unit disclosed in US-A-4055322 (the disclosure of which is incorporated herein by reference) is suitable for use in the present invention.

The plastic fuse may be made from any suitable plastics material. The plastic fuse may be made solely or predominately from a plastics material. Suitable plastics materials are those which burn "cleanly", i.e. with little or no emission of toxic fumes, and which burn (in a flow of oxidant gas, particularly molecular oxygen gas) with sufficient heat to ignite the combustible metal of the outer tube or, preferably, the combustible metal of the wires that may be provided within the fuse (see below).

Suitable plastics materials burn "white hot" in molecular oxygen, e.g. at a temperature of at least 1800° C., usually over 2000° C. and typically at about 2500° C. The combustion temperature depends on the rate of flow of the oxidant gas but it is usually no more than 3000° C.

Examples of suitable plastics materials are selected from the group consisting of polyurethane; polyethylene; polystyrene; and nylon although polyurethane is preferred for the fuse.

The plastic fuse usually further comprises a plurality of combustible metal wires extending from the fuse into said outer tube. The plastic of the fuse ignites the wires which, in turn, facilitate ignition of the outer tube. The diameter of the wires should be no more than 3 mm, e.g. usually from about 1 mm to about 2 mm.

The plastic fuse is preferably tubular, typically in the form of a short (e.g. from about 1 cm to about 10 cm) length of flexible plastic tubing, which may be mounted co-axially at the outlet end portion of the outer tube. Adhesive or any other type of suitable fixing may be used to attach the plastic fuse to the outlet end of the outer tube. However, in preferred embodiments, the inner diameter of at least a portion of the tubular plastic fuse is about the same as (or even slightly smaller than if the tubing is resilient) the outer diameter of the outer tube thereby providing a "friction fit" of the plastic fuse over the outlet end portion of the outer tube. No adhesive is then necessary to attach the plastic fuse to the tube.

The Inventor has discovered that ignition of the thermic lance requires a reduced rate of flow of oxidant gas, at least until ignition is fully established. The reduced flow rate may be provided by careful adjustment of the flow rate of the oxidant gas through the lance. Alternatively, the reduced flow rate may be provided at least in part by at least one first gas flow control aperture provided at the outlet end portion of the lance. The aperture(s) may be provided in the fuse or in the outlet end portion of the outer tube. After the fuse has been consumed, the flow control aperture(s) disappears thereby automatically increasing the flow of oxidant gas through the lance.

The or at least one aperture may be defined by a wall projecting radially either from the inner surface of a tubular plastic fuse provided over the outlet end portion of the outer tube or from the inner surface of the outlet end of the outer tube itself.

The electrical ignition system usually comprises:

an electrical igniter provided at least within ignition range of the fuse;

means of producing electric current in said igniter;

electrical connections for providing an electrical circuit between the electrical igniter and said means for producing electric current; and a switch for remotely controlling the flow of electric current around said electrical circuit to said igniter.

The electrical igniter may be provided in contact with the plastic fuse.

The electrical igniter is preferably a length of NiChrome™ wire. "NiChrome™" is a nickel-chromium alloy with high electrical resistance and an ability to withstand high temperatures. The length of the NiChrome™ wire is usually from about 10 mm to about 30 mm, preferably about 20 mm. In embodiments in which the plastic fuse is tubular, e.g. a short length of plastic tube, the length of NiChrome™ wire is usually formed into a loop and provided in the interior of the plastic fuse. On passing a small current, e.g. no more than a few amps such as from about 1 A to about 3 A, through the NiChrome™ wire, the wire gets very hot, thereby igniting the plastic fuse. An advantage of NiChrome™ wire is that it does not rust in the atmosphere, even in the presence of atmospheric pollutants.

The electrical igniter may be an electric match such as those used to ignite conventional fireworks or model rockets. An electric match is about the size of a conventional match head and typically comprises a solid droplet of rapid burning oxidizer/fuel mixture with a very fine wire built in connected to two robust connecting wires. On passing a small current, no more than about 1 A, the electric match instantly ignites with a faint "bang". In embodiments in which the plastic fuse is tubular, e.g. a short length of plastic tube, the electric match may be provided in the interior of the plastic tube.

The means for producing the electric current is preferably a battery, e.g. a 12 volt battery such as that used in a car.

In another embodiment, the ignition unit is a friction ignition system. The system disclosed in U.S. Pat. No. 4,915,618 (the disclosure of which is incorporated herein by reference) is suitable. However, in a preferred embodiment, the system comprises a rotor and a combustible housing. The housing comprises a gas inlet mounted in gas flow communication with the or at least one gas flow path, and at least one gas outlet. The housing defines a gas flow pathway between the gas inlet and the gas outlet(s). The rotor is mounted within the gas flow pathway for rotation within the housing by a flow of oxidant gas along the gas flow pathway. When a sufficiently high flow of oxidant gas passes along the gas flow pathway of the housing, the rotor rotates relative to the housing. Where the rotor is in contact with the housing, friction occurs between the rotor and the housing producing heat which ignites the combustible housing. The housing then ignites the lance, via a plastic fuse if present.

The rotor usually has a spindle for mounting the rotor within the housing. At least one end of the spindle may be in contact with the housing. In preferred embodiments, the rotor is a turbine within a turbine housing. Pelton wheel, axial or centrifugal flow turbines can be used.

The combustible housing preferably comprises a plastics material. The plastics material is usually a low cost plastics material and may be selected from the same group of materials as the fuse. Preferably, the material is polystyrene.

The rotor may be made from a plastics material or a metal.

The friction ignition system preferably comprises at least one point of contact between the rotor and the housing. In order to facilitate friction ignition, an abrasive material may be provided at the or at least one of the points of contact. Any suitable abrasive material may be used including emery, sand and carborundum.

A frictional match composition may be provided between the rotor and the housing. Any suitable friction match composition may be used. A suitable friction match composition may comprise a chlorate and/or a perchlorate salt. Suitable chlorate and/or perchlorate salts include the ammonium salts and the salts of metals from Group IA and Group IIA of the periodic table. Preferred chlorate and/or perchlorate salts include the salts with sodium; potassium; magnesium; and ammonia.

The thermic lance preferably comprises a combustible plastic tubular fuse mounted co-axially between the outlet end portion of the outer tube and the gas inlet of the friction ignition system. The fuse may be as defined above.

The lance may consist simply of the outer tube, the plastic fuse and the electrical ignition system. However, usually, at least one combustible metal elongate insert is enclosed within the outer tube. One purpose of the insert(s) is to increase the amount of fuel present thereby increasing the amount of oxidation products and heat that may be produced by the lance. The insert(s) defines at least one gas flow path within the outer tube providing gas flow communication between the end portions of said outer tube.

The insert may be in the form of a roll of sheet combustible metal in which case the gas flow path is between layers of the roll. Usually, however, a plurality of combustible metal rods or wires would be packed inside the outer tube in which case the gas flow paths are between each rod or wire. An inner tube of combustible metal having an external diameter that is less than, e.g. about half, the internal diameter of the outer tube may be used as an insert.

The thermic lance preferably further comprises:

an combustible metal inner tube having an oxidant gas inlet end portion and an outlet end portion, said inner tube being provided co-axially within said outer tube with the outlet end portion of the inner tube extending beyond the outlet end portion of the outer tube; and a plurality of combustible metal rods, a portion of said plurality being enclosed within the inner tube and the remaining portion being provided between the inner and outer tubes, said rods defining gas flow paths within the outer tube providing gas flow communication between the end portions of said outer tube.

In such embodiments, the plastic fuse may be mounted only on the outlet end portion of the inner tube. However, the plastic fuse preferably has two parts, a first part mounted on the outlet end portion of the inner tube and a second part mounted on the outlet end portion of the outer tube. The plastic fuse may further comprise a first plurality of combustible metal wires extending from the first part of the fuse into said inner tube and a second plurality of combustible metal wires extending from the second part of the fuse into said outer tube.

In embodiments of the lance comprising an combustible metal inner tube, there may be at least one further first gas flow control aperture provided at the outlet end portion of the lance. The further aperture may be defined by an integral wall projecting radially either from the inner surface of the outlet end portion of the inner tube or from the inner surface of the first part of the plastic fuse.

Pressure fluctuations in the source of the oxidant gas can cause fluctuations during the burning of the lance. The thermic lance preferably comprises an integral wall projecting radially from the inner surface of the outer tube at the oxidant gas inlet end portion thereof defining a second gas flow control aperture for controlling the flow of oxidant gas through the outer tube. Such an aperture has the effect of limiting flow rate of oxidant gas through the lance thereby inhibiting fluctuations in the burning of the lance. The size of the aperture is proportional to the size of the lance.

Such gas flow control apertures have particular application in embodiments in which a plurality of lances are connected to a single source of oxidant gas and used as fireworks. In these embodiments, the fluctuations in oxidant gas pressure may be sufficiently large to extinguish a lance.

A solid oxidant material may be provided on the surface of the combustible metal at the outlet end portion of the outer tube and, if present, of the inner tube and/or rod(s), etc. to allow the tip of the lance to be kept at about the required combustion temperature. Such a feature may be referred to as a "slow fuse". Suitable solid oxidants include metal nitrate or perchlorate salts.

Alternatively, the tip of the lance can be kept at about the required combustion temperature by maintaining a "standby" flow rate, just a few 1min (from about 1 l/min to about 10 l/min, e.g. about 5 l/min) of oxidant gas, e.g. molecular oxygen, to the lance.

When the thermic lance is to be used as a firework, it is often desirable to have different coloured sparks produced therefrom. Different metals produce differently coloured sparks on combustion. For example, lances containing mostly aluminium will produce a silver/white fountain of sparks, while lances containing mostly iron will produce a shower of yellow sparks.

Differently coloured sparks may also be produced by providing at least one colorant on at least a portion of the surfaces of the combustible metal or by adding the colorant to the flow of oxidant gas to the lance. The colorant preferably comprises metal ions which emit light in the visible part of the electromagnetic spectrum when heated. Different metal ions emit different colours. Suitable metal ions include the ions of alkali metals, alkaline earth metals and certain transition metals. Suitable colorants may be selected from the group consisting of the chloride, chlorate and perchlorate salts of alkali metals such as sodium and potassium; of alkaline earth metals such as barium and strontium; and of certain transition metals such as copper.

It is possible to control the size of the sparks produced by a thermic lance, particularly lances having aluminium outer tubes, by providing an outer wrap of a combustible material which does not melt, such as paper. Accordingly, lances may further comprise at least one layer of paper enclosing the outer tube. For example, 6 layers of heavy brown Kraft paper appear to retain the combustible metal of the outer tube, particularly aluminium, until it is hot enough to split into very small sparks, e.g. about 1 mm to about 2 mm in diameter or even less.

The oxidant gas inlet end portion of the outer tube of the lance may be connected by a first conduit to an oxidant gas flow control valve. The flow control valve may, in turn, be connected by a second conduit to a gas regulator provided on a cylinder of compressed oxidant gas. The gas flow control valve may be a normally closed solenoid valve. Accordingly, the thermic lance may further comprise:

a normally closed solenoid valve for controlling the flow of oxidant gas through the lance;

a first conduit for providing gas flow communication between said valve and the oxidant gas inlet end portion of the outer tube of said thermic lance;

means for producing electric current;

electrical connections for providing an electrical circuit between said solenoid valve and said means for producing electric current; and a switch for controlling the flow of electric current around the electrical circuit to each valve.

Preferably, the oxidant gas flow control valve has means to provide an automatic cut off so that the supply of oxidant gas may be stopped automatically once the thermic lance has been consumed.

One option is to include a fusable circuit breaker in the electrical connections. The circuit breaker is preferably mounted at the oxidant gas inlet end portion of the outer tube of the lance. Once the lance has burnt down to the circuit breaker, the breaker melts thereby cutting the circuit. The normally closed solenoid valve then closes automatically, shutting off the oxidant gas supply.

The circuit breaker may be an internally mounted wire loop comprising, for example, strands of copper wire sheathed in PVC insulation. The loop is burned by the burning outer tube and goes "open circuit" which can also be used to shut off the solenoid valve.

A further option would be to use a spring loaded valve mounted in the gas flow path at the oxygen gas inlet end portion of the outer tube of the lance, said valve being biased in the open position by a fusable detent, i.e. a detent that melts at the temperature that may be produced by the thermic lance, e.g. from about 1000° C. to about 2600° C. Again, once the burning outer tube reaches the detent, the detent melts thereby releasing the spring loaded valve to close off the supply of oxidant gas.

The spring loaded valve may be a "ball-spring" type of check valve mounted so that it points up stream. Such a valve comprises a ball which seals on the end of a cylindrical inlet, pushed by a spring, and will normally only allow reverse flow and not forward flow. The forward flow is allowed by a valve opener, such as a piece of metal, e.g. a thin tube, inside a cylindrical input, which pushes the ball off its sealing face. It is held in place by a detent, e.g. an annulus or a cross-flow pin, made of an easily fusable material. When the oxygen flame reaches the detent, the detent melts allowing the valve opener to move backwards against the flow, allowing the ball, under spring pressure, to seal against the inlet flow.

It may be necessary to extinguish the lance immediately in the event of an emergency. Therefore, the lance may be connected to a source of a pressurised inert gas such as nitrogen or carbon dioxide via a valve. In the event of an emergency, the oxidant gas supply may be shut off and the inert gas supply turned on. The lance would immediately be extinguished although would remain hot for some time.

The shape of the cross section of the outer (or inner) tube is not critical to the present invention. The shape is usually circular. However, other polygonal shapes such as triangular, square, pentagonal, etc. may be used as suitable cross sectional shapes.

Similarly, the dimensions of the outer tube are also not critical to the present invention. Tubes with an outer diameter of up to about 30 mm, e.g. about 26 mm, have been tested and shown to work as desired. The size of the bore of the outer tube is usually about 5 mm to about 30 mm, but is typically no more than 20 mm, e.g. about 14 mm. The thickness of the tube wall is usually from 0.75 mm to about 1.25 mm, e.g. about 1 mm. The length of the outer tube is also not critical to the invention. The only limitation on length appears to be being able to provide a high enough flow of oxidant gas. The length usually from about 0.5 m to about 10 m, e.g. about 6 m, or about 0.5 m to about 3 m, e.g. 2 m.

Any suitable combustible metal may be used for the outer tube, the wires of the plastic fuse and the insert(s). Suitable combustible metals include metals comprising iron; aluminium; or magnesium. Suitable metals are preferably iron or, more usually, steel such as mild steel (CAS number 7439-89-6) or carbon steel (e.g. about 1% carbon, 0.35% manganese, the remainder being predominately iron and any impurities); aluminium such as high purity aluminium (CAS number 742-99-05); and magnesium. However, alloys of iron with other metals such as aluminium and/or magnesium may also be used. Further colours may be produced by using alloys of at least one first metal selected from iron and aluminium and at least one second metal selected from the metals from Group IA and Group IIA of the periodic table. A preferred alloy is made from aluminium and strontium. This alloy produces red sparks. The Inventor Better sparks are observed if carbon steel is used in place of mild steel.

In preferred embodiments, the outer tube is made from iron or steel; a portion of the plurality of inserts is made from iron or steel; the remaining portion of the plurality of inserts is made from aluminium or magnesium; and the wires in the plastic fuse are made from iron or steel. In embodiments having an inner tube as an insert, together with a plurality of rods, the inner tube is usually made from aluminium; and each rod is made from iron or steel. If present, the proportion of aluminium in the lance is usually in the range of about 5 wt % to about 95 wt %.

The flow of high pressure gas through the outer tube of a thermic lance is known to dislodge inserts provided within the tube. Therefore, the outer tube may be "crimped" or may comprise an S-bend at or near the oxidant inlet end portion thereof to inhibit insert(s) from becoming dislodged and from being ejected out of the outlet end of the outer tube.

Any suitable oxidant gas may be used. However, the oxidant gas usually at least comprises gaseous molecular oxygen. Thus, the oxidant gas could be air. However, in much preferred embodiments, the oxidant gas is molecular oxygen ("$O_2$").

The operating pressure of the oxidant gas is usually from 100 kPa to about 5 MPa, e.g. from about 200 kPa to about 400 kPa.

The lances in the system of the second aspect may be identical or at least some may be different, e.g. have different length, diameter, colour, etc. The lances usually each have a remote ignition system and at least one lance, preferably all, is as described above.

The system preferably further comprising a control system for remotely operating said valves. Where each valve is a normally closed solenoid valve, the control system preferably comprising:

means for producing electric current;

electrical connections for providing an electrical circuit between each solenoid valve and said means for producing electric current; and a switch for controlling the flow of electric current around each electrical circuit to each valve.

A reduced rate of oxidant gas flow may be provided by a flow restricting valve in parallel with the oxidant gas flow control valve. For example, the thermic lance may comprise a bypass valve in parallel with the solenoid valve for providing oxidant gas to the thermic lance at an "ignition" flow rate for ignition of the thermic lance while the solenoid valve is closed. The lance may therefore be ignited with the solenoid valve closed and then run at a "display" flow rate by opening the solenoid valve. A further advantage is that this arrangement of parallel valves provides a means for switching the lance between "on" and running at high oxidant gas flow rate, and on "standby" running at a low oxidant gas flow rate sufficient to maintain a flame on the lance tip to prevent the lance from extinguishing.

Where appropriate, the system preferably comprises a single means for producing electric current to operate each electrical igniter. Where appropriate, the same control wires can operate the ignition system current and the control valve system.

The source of pressurized oxidant gas may be a single cylinder of said gas, e.g. for smaller sized displays. A bank of cylinders of compressed gas, such as a manifolded set or "pack" of cylinders, may be used as the source of pressurised gas, e.g. for medium sized displays. At least one tank of liquefied oxidant gas may be used as the source of pressurised oxidant gas, e.g. for larger (or multiple) displays. In these embodiments, the liquefied oxidant gas is vaporised and the pressure of the gas adjusted to the operating pressure. Obviously, in embodiments where the oxidant gas is gaseous molecular oxygen, the tank(s) would contain liquid oxygen ("LOX").

Where the source of oxidant gas is one or more cylinders of pressurised gas, the pressure of the stored oxidant gas is usually about 30 MPa. The oxidant gas is fed through a regulator to reduce the pressure before use to an operating pressure in the range from about 100 kPa to about 5 MPa and usually no more than about 1 MPa. Preferred operating pressures include about 700 kPa or from about 200 kPa to about 400 kPa. Where the source of oxidant gas is a tank of liquefied oxidant gas, the liquefied gas is vaporised to produce the oxidant gas and then the pressure is adjusted as required.

Where the oxidant gas is molecular oxygen, the high pressure part of the system must be made from metals such as copper or brass (which will not combust in the oxygen) and must be "oxygen-clean", i.e. thoroughly degreased.

The cylinder(s) supply (e.g. at about 30 MPa) feeds a pressure reduction device, e.g. a pressure regulator which reduces the pressure of the oxidant gas to an operating pressure, e.g. from about 100 kPa to about 1 MPa, which allow the safe use of plastic and rubber parts and ordinary pneumatic fittings in the rest of the system.

In the event of an emergency, the lance may be extinguished simply by shutting off the oxygen supply to the lance. However, if more rapid or complete shutdown is required then an inert gas such as nitrogen or carbon dioxide may also be used. In such embodiments, the system may further comprise:

a source of pressurised inert gas;

an inert gas flow control valve;

a third conduit for providing gas flow communication between said source of pressurised inert gas and said inert gas flow control valve; and wherein said inert gas flow control valve is in gas flow communication with each lance.

In some embodiments, the flow control valves for the oxidant gas and the inert gas may be integrated within the same valve manifold, for example, the valve manifold of the lance holder if used as a cutting or boring tool. In other embodiments, these flow control valves may be separate and the system may further comprise a fourth conduit for providing gas flow communication between the inert gas flow control valve and the second conduit. In these embodiments, the oxidant gas supply could be shut off and then inert gas allowed to flow through the lance(s) to extinguish the lance (s).

If coloured fireworks are required, the system may further comprise lances which have a colorant provided on at least a portion of the surfaces of the combustible metal. Alternatively, the system may further comprise:

at least one source of colorant; and means for adding said colorant from said source to a flow of oxidant gas in the second conduit. Each lance may be connected to a different source of colorant thereby producing different coloured flames. Where the colorant is in powdered form, the system may further comprise means for adding powdered colorant to a flow of oxidant gas. Suitable means include powder feed systems employing a sealed powder hopper as used in the metal spraying and flame-spraying industry.

Each lance in the system may have any of the above mentioned features described in respect of the first aspect in any appropriate combination.

In the method of the third aspect, the "ignition" flow rate is preferably from about 1 l/min to about 10 l/min, e.g. about 5 l/min. The "standby" flow rate is preferably from about 1 l/min to about 10 l/min, e.g. about 5 l/min. The "standby" flow rate is usually just sufficient to maintain the combustion temperature at the tip of the lance and, thus, is usually no less than and may be the same as the "ignition" flow rate. Minimal amounts of sparks are emitted using a "standby" flow rate. The "display" flow rate is usually from about 10 l/min to about 1000 l/min, e.g. from about 200 to about 600 l/min, depending on the effect to be achieved and the size of the lance.

The flow rate may be increased from the "standby" flow rate to the "display" flow rate shortly after ignition if the firework is required straight away or may be increased some time after ignition if the firework is not required immediately but would be required to spring to life in a moment. The "standby" flow rate is usually the same as the "ignition" flow rate".

The height to which the sparks are ejected from the lance is dependent to a certain extent on the "display" flow rate of oxidant gas. Thus, a higher "display" flow rate generally results in a greater height to which the sparks are ejected.

High "display" flow rate of oxidant gas achieves a "fountain" effect from the lance. For example, a flow rate of 500 l/min in a thermic lance having a bore of 14 mm ejects sparks at least 5 m into the air.

Conversely, low "display" flow rate of oxidant gas can create a "waterfall" effect where a downward flow of sparks is created even if the lance is pointing upwards. A low "display" flow rate is, for example, from 30 l/min to 150 l/min, e.g. 100 l/min.

The "display" flow rate may be varied during a display to vary the display of sparks. In addition, a lance may be returned to the "standby" flow rate after a "display" flow rate until the lance is required again.

Orientation of the lance(s) at any angle or inclination, e.g. sidewards or downwards orientation, is obviously also possible. If a lance is operated on a hard surface, the falling molten droplets can be further divided into smaller sparks when they impact the surface, thereby providing a further desirable aesthetic effect. In addition, lances may be waved and/or rotated to provide further aesthetic effects. With rapid movement of the lances and lance on/off switching, it would be possible to "write" symbols, words and/or messages or to "draw" pictures in the air.

Rotating spark-fountains such as Catherine Wheels, Revolving Suns or Pin Wheels can be created by employing vertically rotating fountains using a rotating joint to the provide the oxidant gas. Horizontally rotating fountains such as Carousels or "girandolas" can also be achieved in this way. The tips of rapidly rotating lances are moving very fast which can provide enhanced long distance spark projection. Further effects can be achieved with rotating spark-fountains by programming the oxidant gas pressure to pulse on and off during the rotation.

Pulsing the oxidant gas pressure can also be employed to synchronise fountains of sparks with musical accompaniment in the manner of 'son-et-lumiere' firework displays.

There is also provided apparatus comprising:

at least one thermic lance;

a source of pressurised oxidant gas;

an oxidant gas flow control valve for the or each thermic lance;

a first conduit for the or each pairing of a valve and a thermic lance, the or each first conduit for providing gas flow communication between said valve and the oxidant gas inlet end portion of said thermic lance;

a second conduit for providing gas flow communication between said source of pressurised oxidant gas and the or each valve;

characterised in that said apparatus further comprises:

a source of pressurised inert gas;

an inert gas flow control valve;

a third conduit for providing gas flow communication between said source of pressurised inert gas and said inert gas flow control valve; and wherein said inert gas flow control valve is in fluid flow communication with the or each lance.

The thermic lance(s) may be a conventional thermic lance, i.e. not have combustible plastic fuse. Alternatively, the thermic lance(s) may be a lance as described above. In embodiments involving more than one lance, each lance may be either a conventional lance or a lance as described above. Alternatively, a mixture of conventional and present lances may be used. The lance(s) may have any or all of the features of the lances as defined above in any appropriate combination.

The thermic lance according to the fourth and fifth aspects may have any appropriate combination of features described above.

The or each lance may be used as a cutting or boring tool or as a firework. In embodiments in which the apparatus has only one lance, the lance would usually be used as a cutting or boring tool. In embodiments in the apparatus has a plurality of lances, the apparatus would usually be used as a firework system.

The present invention will now be described by way of example only and with reference to the accompanying figures.

Figure 2:
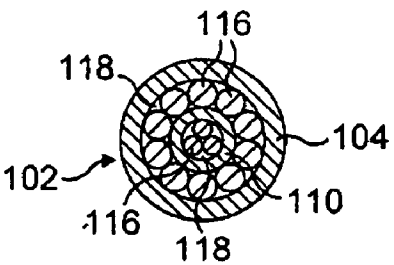
FIG. 2 is a cross sectional representation through line A-A of the thermic lance depicted in FIG. 1.

Referring to FIGS. 1 and 2, a thermic lance (102) has an outer tube (104) made from iron or steel having an oxygen gas inlet end portion (106) and an outlet end portion (108). The outer tube (104) is of circular cross section and has an outside diameter of about 16 mm, a bore of about 14 mm and a length of about 2 m.

The lance (102) has an inner tube (110) provided co-axially within the outer tube (104). The inner tube (110) has an oxygen gas inlet end portion (112) and an outlet end portion (114) extending beyond the outlet end portion (108) of the outer tube (104). The inner tube is made from aluminium.

The lance (102) has a plurality rods (116) enclosed within the outer tube (104). A portion of the plurality is enclosed within the inner tube (110) and the remainder of the plurality is packed between the inner tube (114) and the outer tube (104). The rods (116) are made from iron or steel and define a plurality of gas flow paths (118) providing gas flow communication between the oxygen gas inlet end portion (106) and the outlet end portion (108) of the outer tube (104).

A polyurethane fuse (120, 122) is mounted on the outlet of the lance (102). The fuse (120, 122) is in two parts; a first part (120) mounted on the outlet end portion (114) of the inner tube (110) and a second part (122) mounted on the outlet end portion (118) of the outer tube (104). Each part (120, 122) is a length of flexible polyurethane tubing. The first part (120) has an internal diameter of no more than the external diameter of the inner tube (110) to provide a friction fit with the inner tube (110). The second part (122) has an internal diameter of no more than the external diameter of the outer tube (104) to provide a friction fit with the outer tube (104).

A plurality of iron or steel fuse wires (124) are provided within the parts (120, 122) of the fuse and extend into the inner (110) and outer (104) tubes. The diameter of the fuse wires (124) is no more than 2 mm.

A loop (126) of NiChrome wire is provided in the first part (120) of the polyurethane fuse (120, 122). The loop (126) is part of an electrical ignition system (not shown) for igniting the polyurethane fuse (120, 122).

The lance (102) has a first gas flow control aperture (128) provided in the outlet end portion (114) of the inner tube (110) and a second gas flow control aperture (130) in the oxygen gas inlet end portion (106) of the outer tube (104).

The lance (102) also has a "crimped" portion (132) near the oxygen gas inlet end portion (106) of the outer tube (104) of the lance (102) which grips the internal components (110, 116) of the lance (102) to prevent them from being ejected out of the lance (102) during use.

The thermic lance (102) is ignited by applying an electric current of about 2 A using the electrical ignition system (not shown) through the loop (126) of NiChrome wire while oxygen gas is passed through the lance (102) at a low flow rate of about 5 l/min. The loop (126) becomes hot and ignites the first part (120) of the polyurethane fuse (120, 122).

The polyurethane fuse burns "white hot" in oxygen, i.e. it burns at a sufficiently high temperature, e.g. about 2000° C., to ignite the iron fuse wires (124). The combination of the ignited fuse wires (124) and burning first part (120) of the polyurethane fuse (120, 122) in the oxygen flow is sufficient to ignite the outlet end portion (114) of the inner tube (110).

The second part (122) of the fuse (120, 122) and the remaining iron fuse wires (124) are ignited by the heat from the burning first part (120) of the fuse and from the iron that is already ignited. There is now sufficient heat to ignite the iron in the outlet end portion (108) of the outer tube (104) of the lance (102) and the ends of the rods (116) in the oxygen gas flow.

The flow of oxygen through the lance (102) can be maintained at a "standby" flow rate (e.g. about 5 l/min) until the lance is required for use, e.g. as a thermic lance for cutting or boring purposes or as a firework, at which point the oxygen flow rate can be increased to an operating or "display" flow rate from about 10 l/min to about 1000 l/min, e.g. about 100 l/min, depending upon lance size and the degree of spark projection required.

Figure 3:
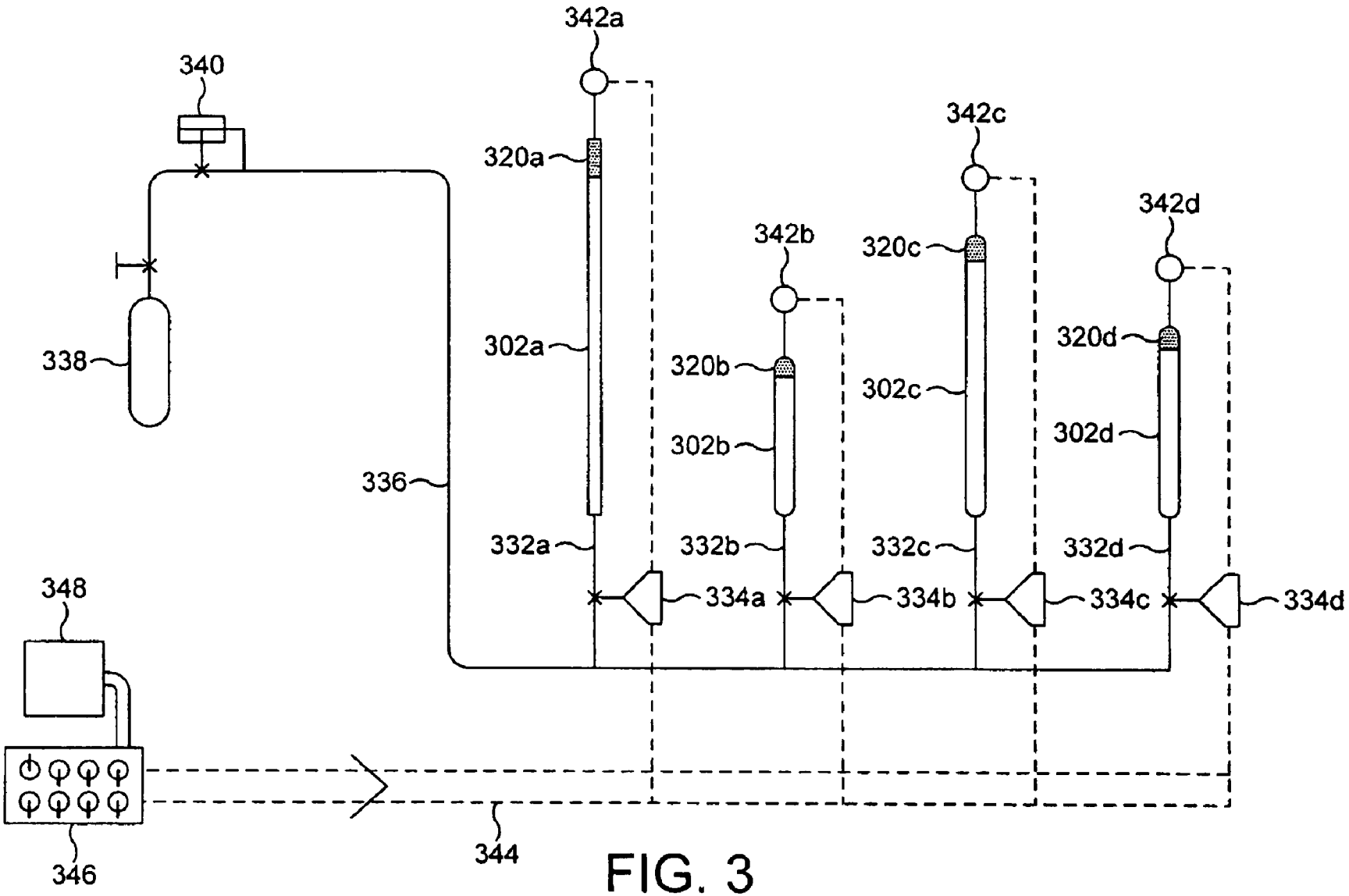
FIG. 3 is a schematic representation of one possible arrangement of a system fireworks according to the present invention.

FIG. 3 represents schematically how four lances (302*a*, 302*b*, 302*c*, 302*d*) as depicted in FIGS. 1 and 2 might be connected for use as a system of fireworks.

The first lance (302*a*) is connected via a first gas conduit (332*a*) to a normally closed solenoid valve (334*a*) which, in turn, is connected via a second gas conduit (336) to a source (338) of high pressure oxygen gas via a pressure regulator (340). An example of a suitable source is a cylinder (338) of compressed oxygen gas at a pressure of about 30 MPa.

The outlet end portion of the lance (302*a*) is connected to a polyurethane fuse (320*a*) which in turn is connected to an electrical igniter (342*a*). The electrical igniter (342*a*) and the solenoid valve (334*a*) are connected by the same circuit (344) to a switch array (346) (or a computer operated array of relays) powered by a means (348) of producing electric current which, in this case, is a battery.

The electrical igniter (342*a*) may be on a separate circuit from the solenoid valve (334*a*) and, thus, the igniter (342*a*) and the valve (334*a*) may be independently controllable.

Each of the remaining lances (302*b*, 302*c*, 302*d*) is connected in the same way as the first lance (302*a*).

In use, oxygen gas flows from the source (338) through the regulator (340) where the pressure is reduced from about 30 MPa to about 700 kPa to the solenoid valves (334*a*, 334*b*, 334*c*, 334*d*).

When a particular lance is required, electrical current is passed through the relevant part of the circuitry (344) to open the respective valve and to ignite the electrical igniter thereby igniting the lance itself. Once lit, the lance may be used as a firework simply by increasing the flow of oxygen through the lance (e.g. by opening the solenoid valve further).

A firework display may be created by the sequential opening and closing of the solenoid valves or otherwise varying oxidant gas flow rates in particular orders to create aesthetically pleasing patterns and effects.

Figure 4:
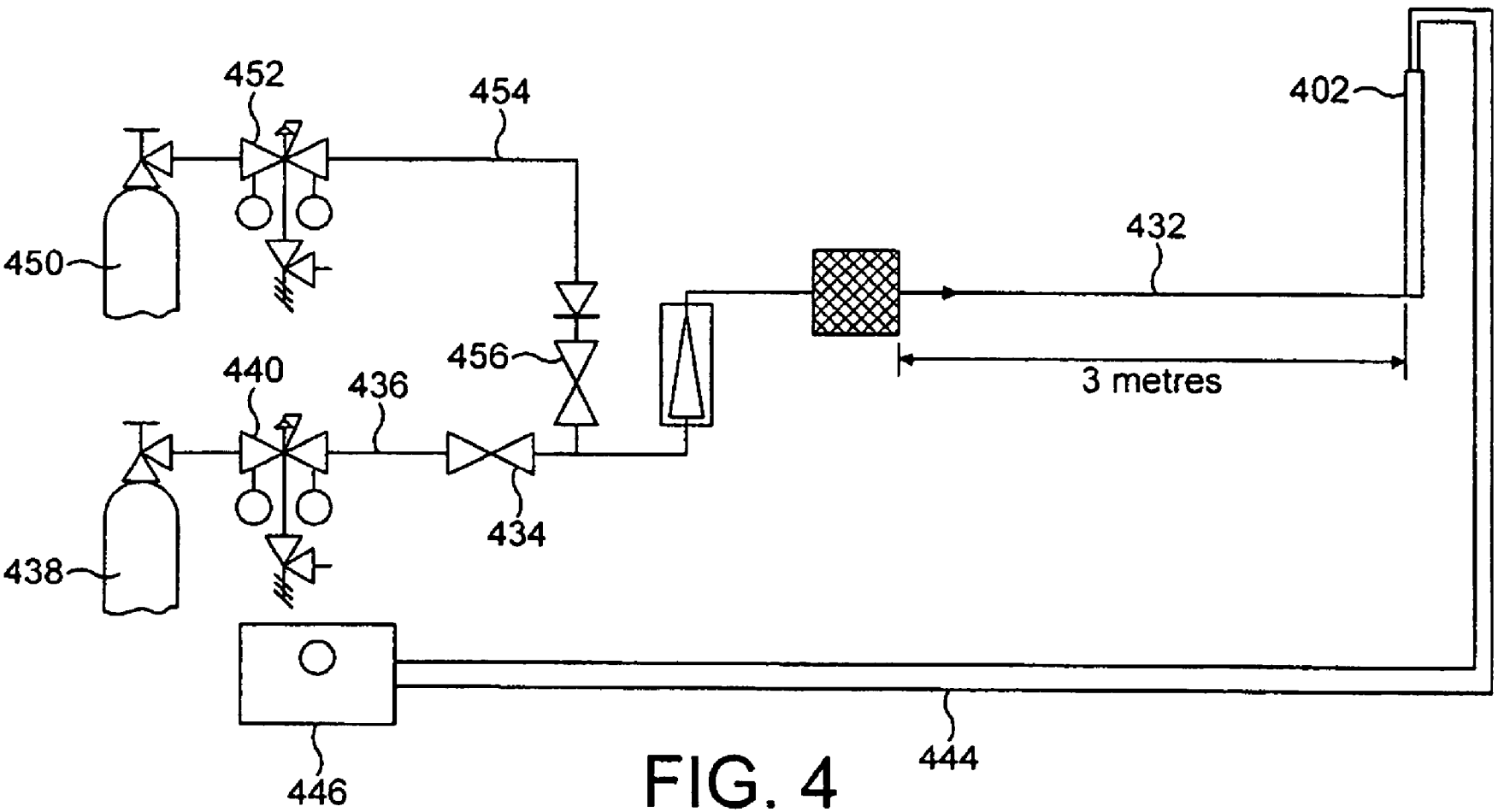
FIG. 4 is a schematic representation of the arrangement used in the Example to test the lance as a firework.

FIG. 4 is a schematic representation of the test arrangement used in the following Example. A lance (402) is connected to a cylinder (438) of oxygen gas at 30 MPa via conduits (432, 436) and valves (434, 440). Ignition of the lance is provided by the electrical ignition system (444, 446). A cylinder (450) of compressed carbon dioxide gas is connected by a pressure regulator (452) and a conduit (454) to a second valve (456).

The firework (402) is operated as described above and may be extinguished in an emergency by shutting off the oxygen supply (i.e. by closing valve (434)) to the firework and, instead, supplying carbon dioxide (i.e. by opening valve (456)) to the firework.

Figure 5A:
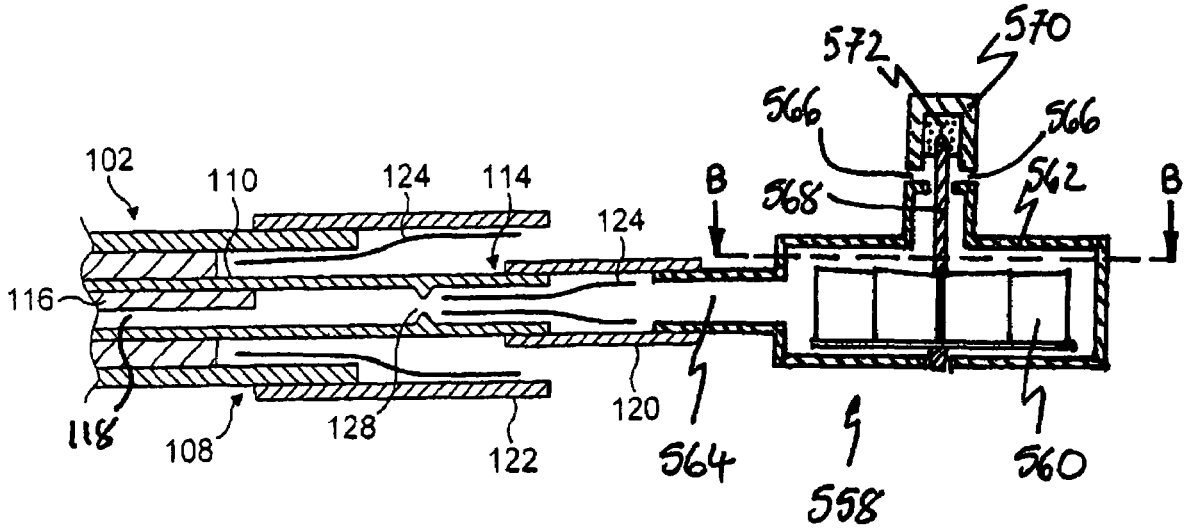
FIG. 5A is a cross sectional representation of a friction ignition system mounted at the outlet end portion of a thermic lance of FIG. 1 in place of the electrical ignition system.
Figure 5B:
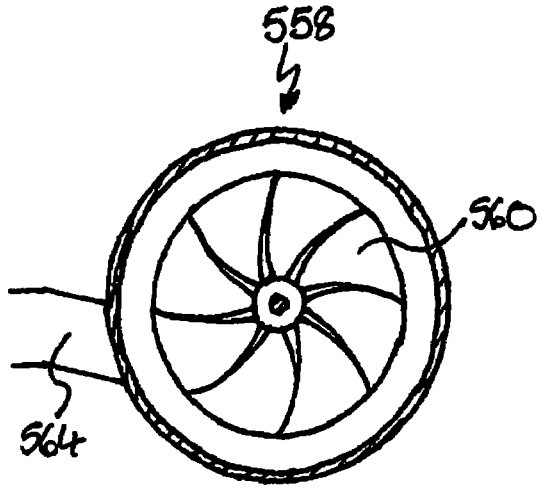
FIG. 5B is a cross sectional representation through B-B of the friction ignition system of FIG. 5A.

Referring to FIGS. 5A and 5B, a friction ignition system or unit (558) is mounted at the outer end portion (108) of the outer tube (104) of the lance (102) described in FIG. 1. Specifically, the friction ignition system (558) is mounted on the plastic fuse (120) on the inner tube (110).

The friction ignition system (558) has a rotor (560) and a combustible housing (562, 570). The rotor has a spindle (568) for mounting the rotor within the main body of the housing (562). The housing (562, 570) has a gas inlet (564) mounted in gas flow communication with at least one gas flow path (118), and at least one gas outlet (566). The housing (562, 570) defines a gas flow pathway between the gas inlet (564) and the gas outlet(s) (566). The rotor (560) is mounted for rotation within the gas flow pathway.

The top portion (570) of the housing holds an small quantity of a friction match composition (572), usually comprising a chlorate and/or perchlorate salt such as potassium perchlorate. One end of the spindle (568) extends into the composition (572). The other end of the spindle extends into an aperture in the main body (5672) of the housing.

In the exemplified embodiment, both the rotor and the housing are made from a plastics material such as polystyrene.

A flow of oxidant gas, usually $O_2$, is passed through the lance (102) and turns the rotor (560). The rotor rotates within the housing (562, 570) and friction occurs between the rotor (560) and the housing (562), producing heat which ignites the housing (562). Rotation of the rotor (560) also ignites the friction match composition (572) which in turn also ignites the housing (562, 570). Once ignited, the friction ignition system (558) ignites the plastic fuse (120) and the lance is then ignited in the usual way.

EXAMPLE

A firework system was set up as depicted in FIG. 4. The lance (402) was 2 m long and consisted of an outer steel tube of circular cross section, having an outside diameter of about 16 mm and a bore of about 14 mm, enclosing a plurality of soft iron wires and aluminium tubing. A polyurethane fuse was provided at the outlet end portion of the lance.

The lance was ignited electrically and gaseous molecular oxygen at a pressure of about 200 kPa to about 400 kPa was passed through the lance at a flow rate of 10 l/min initially, then, after ignition, at 500 l/min.

Ignition took about 10 s after which the lance burnt successfully with a plume of bright white flame and a shower of bright white and yellow sparks until the whole of the lance had been consumed which took about 2 minutes. The height of the plume was about 6 m.

Lances up to 6 m in length and having an outer diameter of 26 mm have been tested and ignited successfully using the rotary friction ignition system depicted in FIGS. 5A and 5B.

Advantages of preferred embodiments the present invention include:

Safer and more convenient ignition of thermic lances;

Reliable remote ignition of thermic lances;

Safer to make, transport and store than conventional fireworks;

Safer to use than conventional fireworks as the firework may be extinguished by shutting off the oxygen supply;

Less toxic than conventional fireworks;

Less expensive than conventional fireworks; and

Less harmful to the environment than conventional fireworks.

Throughout the specification, the term "means" in the context of means for carrying out a function, is intended to refer to at least one device adapted and/or constructed to carry out that function.

It will be appreciated that the invention is not restricted to the details described above with reference to the preferred embodiments but that numerous modifications and variations can be made without departing from the spirit or scope of the invention as defined by the following claims.

The invention claimed is:

1. A thermic lance comprising:

a combustible metal outer tube having an oxidant gas inlet end portion and an outlet end portion, the end portions being in gas flow communication along at least one gas flow path; and a friction ignition system mounted at the outlet end portion of the outer tube, the friction ignition system comprising a rotor and a combustible housing, the housing comprising a gas inlet mounted in gas flow communication with the at least one gas flow path, and at least one gas outlet, the housing defining a gas flow pathway between the gas inlet and the gas outlet(s), the rotor being mounted within the gas flow pathway for rotation within the housing by a flow of gas along the gas flow pathway.

2. The thermic lance of claim 1, wherein the combustible housing comprises a plastics material.

3. The thermic lance of claim 1, wherein the rotor is mounted in direct contact with the housing.

4. The thermic lance of claim 1, wherein the friction ignition system further comprises at least one point of contact between the rotor and the housing and wherein an abrasive material is provided at the at least one point of contact.

5. The thermic lance of claim 1, wherein a frictional match composition is provided between a portion of the rotor and a portion of the housing.

6. The thermic lance of claim 1, further comprising a combustible plastic tubular fuse mounted co-axially between the outlet end portion of the outer tube and the gas inlet of the friction ignition system.

7. The thermic lance of claim 6, wherein the combustible plastic tubular fuse further comprises a plurality of combustible metal wires extending from the combustible plastic tubular fuse into the outer tube.

8. The thermic lance of claim 6, wherein the combustible plastic tubular fuse is made from a plastics material selected from the group consisting of polyurethane; polystyrene; polyethylene; and nylon.

9. The thermic lance of claim 1, further comprising at least one first gas flow control aperture provided at the outlet end of the outer tube or in the combustible plastic tubular fuse for controlling gas flow through the combustible plastic tubular fuse.

10. The thermic lance of claim 1, further comprising a combustible metal inner tube having an oxidant gas inlet end portion and an outlet end portion, the combustible metal inner tube being provided co-axially within the combustible metal outer tube with the outlet end portion of the combustible metal inner tube extending beyond the outlet end portion of the combustible metal outer tube; and a plurality of combustible metal rods, a portion of the plurality of combustible metal rods being enclosed within the combustible metal inner tube and the remaining portion of the plurality of combustible metal rods being provided between the combustible metal inner tube and the combustible metal outer tube, the rods defining gas flow paths within the combustible metal outer tube providing gas flow communication between the end portions of the combustible metal outer tube.

11. The thermic lance of claim 10, further comprising a combustible plastic fuse mounted at the outlet end portion of the combustible metal outer tube for igniting the thermic lance, wherein the plastic fuse has two parts, a first part mounted on the outlet end portion of the combustible metal inner tube and a second part mounted on the outlet end portion of the combustible metal outer tube.

12. The thermic lance of claim 11, wherein the combustible plastic fuse further further comprises a first plurality of combustible metal wires extending from the first part of the combustible plastic fuse into the combustible metal inner tube and a second plurality of combustible metal wires extending from the second part of the combustible plastic fuse into the combustible metal outer tube.

13. The thermic lance of claim 1, further comprising an integral wall projecting radially from an inner surface of the combustible metal outer tube at the oxidant gas inlet end portion thereof defining a second gas flow control aperture for controlling the flow of an oxidant gas through the combustible metal outer tube.

14. The thermic lance of claim 1, further comprising at least one colorant provided on at least a portion of a surface of the combustible metal.

15. The thermic lance of claim 1, further comprising at least one layer of paper enclosing the combustible metal outer tube.

16. The thermic lance of claim 1, further comprising:

a solenoid valve for controlling the flow of an oxidant gas through the thermic lance;

a first conduit for providing gas flow communication between the solenoid valve and the oxidant gas inlet end portion of the combustible metal outer tube;

means for producing an electric current;

at least one electrical connection for providing an electrical circuit between the solenoid valve and the means for producing electric current; and a switch for controlling the flow of the electric current around the electrical circuit to the solenoid valve.

17. The thermic lance of claim 1, wherein a solid oxidant material is provided on at least a portion of the outlet end portion of the combustible metal outer tube.

18. The thermic lance of claim 1, wherein the combustible metal is an alloy comprising at least one first metal selected from the group consisting of iron and aluminium, and at least one second metal selected from the group consisting of the metals from Groups IA and IIA of the periodic table.

* * * * *